US011485567B2

(12) United States Patent
Lin et al.

(10) Patent No.: US 11,485,567 B2
(45) Date of Patent: Nov. 1, 2022

(54) COAXIAL CONTAINER FOR DISPENSING A TUBULAR PRODUCT

(71) Applicants: SHI CHIA LIN INDUSTRY CO., LTD., Chang Hua (TW); Yuze Industrial Co., Ltd., Taichung (TW)

(72) Inventors: Yu-Chieh Lin, Chang Hua (TW); Chiu-Tse Huang, Taichung (TW)

(73) Assignees: SHI CHIA LIN INDUSTRY CO., LTD., Chang Hua (TW); Yuze Industrial Co., Ltd., Taichung (TW)

( * ) Notice: Subject to any disclaimer, the term of this patent is extended or adjusted under 35 U.S.C. 154(b) by 264 days.

(21) Appl. No.: 16/844,801

(22) Filed: Apr. 9, 2020

(65) Prior Publication Data

US 2021/0316936 A1 Oct. 14, 2021

(51) Int. Cl.
*B65D 83/00* (2006.01)
*B65D 83/02* (2006.01)

(52) U.S. Cl.
CPC ..... *B65D 83/0005* (2013.01); *B65D 83/02* (2013.01); *B65D 2583/00* (2013.01)

(58) Field of Classification Search
CPC ..... B65D 83/0005; B65D 83/02; B65D 2583/00; A45D 40/06
USPC .... 222/286, 379; 401/55–72, 75–83, 73, 74; 220/324; 215/317, 282
See application file for complete search history.

(56) References Cited

U.S. PATENT DOCUMENTS

| | | | | |
|---|---|---|---|---|
| 2,482,368 | A * | 9/1949 | Reichenbach | A45D 40/06 401/61 |
| 5,096,318 | A * | 3/1992 | Susini | A45D 40/06 401/78 |
| 5,324,126 | A * | 6/1994 | Holloway | A45D 40/06 401/78 |
| 5,649,777 | A * | 7/1997 | Holloway | A45D 40/16 401/74 |
| 6,412,999 | B1 * | 7/2002 | Pierpont | A45D 40/12 401/74 |
| 10,765,193 | B2 * | 9/2020 | Domy | A45D 40/04 |
| 2007/0059088 | A1 * | 3/2007 | Chan | A45D 40/06 401/75 |

FOREIGN PATENT DOCUMENTS

WO WO 2008/096149 A1 * 8/2008

* cited by examiner

*Primary Examiner* — Lien M Ngo

(57) ABSTRACT

A coaxial container for dispensing a tubular product has an inner tube connected to a rotating base allowing the inner tube and the rotating base to rotate relatively. A plurality of elastic latches are arranged in a full circle and disposed on a bottom portion of the inner tube connected to the rotating base, each elastic latch has a harder and thicker first potion and a softer and thinner second potion, and the first potion of the elastic latch is capable of making contact with the inner tube.

2 Claims, 5 Drawing Sheets

COAXIAL CONTAINER FOR DISPENSING A TUBULAR PRODUCT

BACKGROUND OF INVENTION

Field of Invention

The present invention relates to a coaxial container, and more particularly to a coaxial container for dispensing a tubular product.

Description of the Related Art

According to US Patent publication No. 2007/0059088, a conventional lipstick box structure is disclosed, however, following problems can be found in its actual application: The positioning piece 13 cannot provide a full circle of support, so the rotating base 11 is still tilled after assembly.

In addition, U.S. Pat. No. 5,842,803 discloses another conventional lipstick box structure, however the following problems still exist in its actual application: 1. The ribs 114, 14*a*, 14*b*, 14*c*, 14*d* cannot provide a full circle of support. 2. Each rib 14, 14*a*, 14*b*, 14*c*, 14*d* is made of the same material, so it cannot form a different inner and outer resistance force after assembly which causes poor concentricity. 3. The ribs 14, 14*a*, 14*b*, 14*c*, 14*d* are provided with a fixed structure, which provides poor resistance.

Therefore, it is desirable to provide a coaxial container for dispensing a tubular product to mitigate and/or obviate the aforementioned problems.

SUMMARY OF THE INVENTION

An objective of present invention is to provide a coaxial container for dispensing a tubular product, which is capable of improving the above-mention problems.

In order to achieve the above mentioned objective, a coaxial container for dispensing a tubular product has an inner tube connected to a rotating base allowing the inner tube and the rotating base to rotate relatively. A plurality of elastic latches are arranged in a full circle and disposed on a bottom portion of the inner tube connected to the rotating base, each elastic latch has a harder and thicker first potion and a softer and thinner second potion, and the first potion of the elastic latch is capable of making contact with the inner tube.

Other objects, advantages, and novel features of invention will become more apparent from the following detailed description when taken in conjunction with the accompanying drawings.

DETAILED DESCRIPTION OF THE PREFERRED EMBODIMENT

Figure 1:
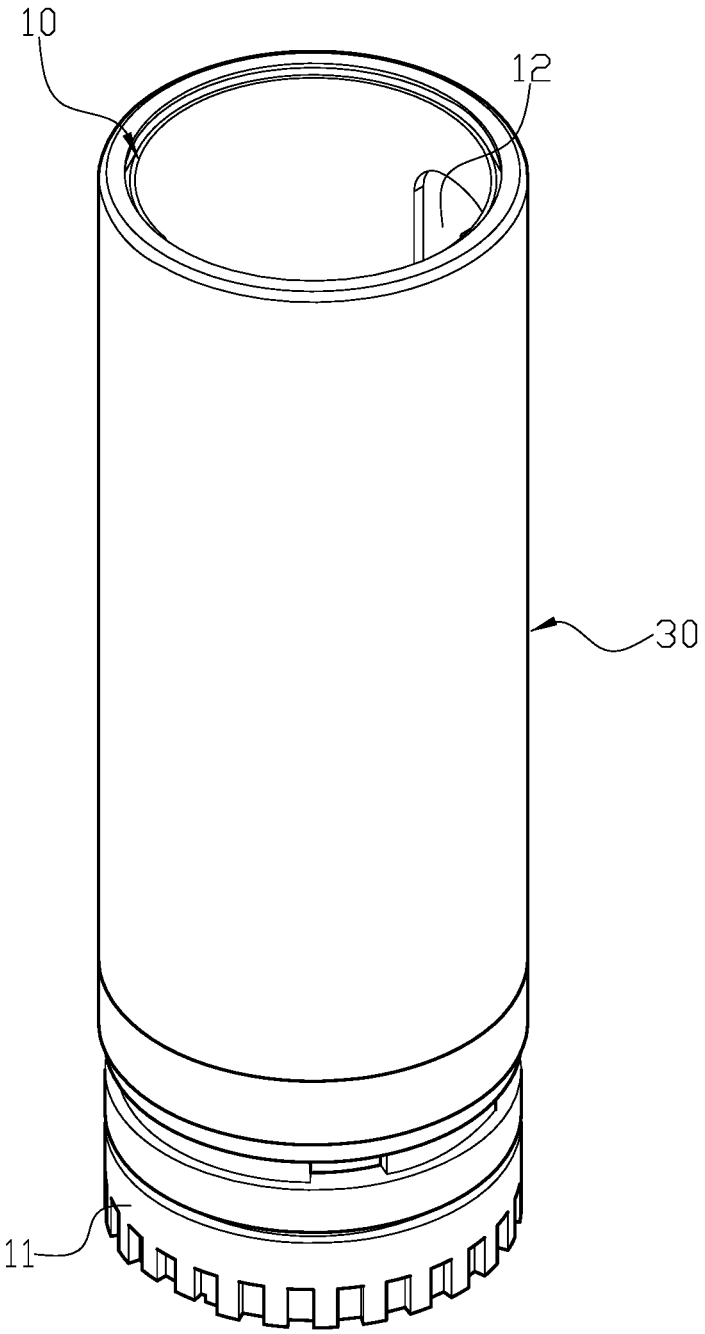
FIG. 1 is a three-dimensional combination drawing of a preferred embodiment according to the present invention.
Figure 2:
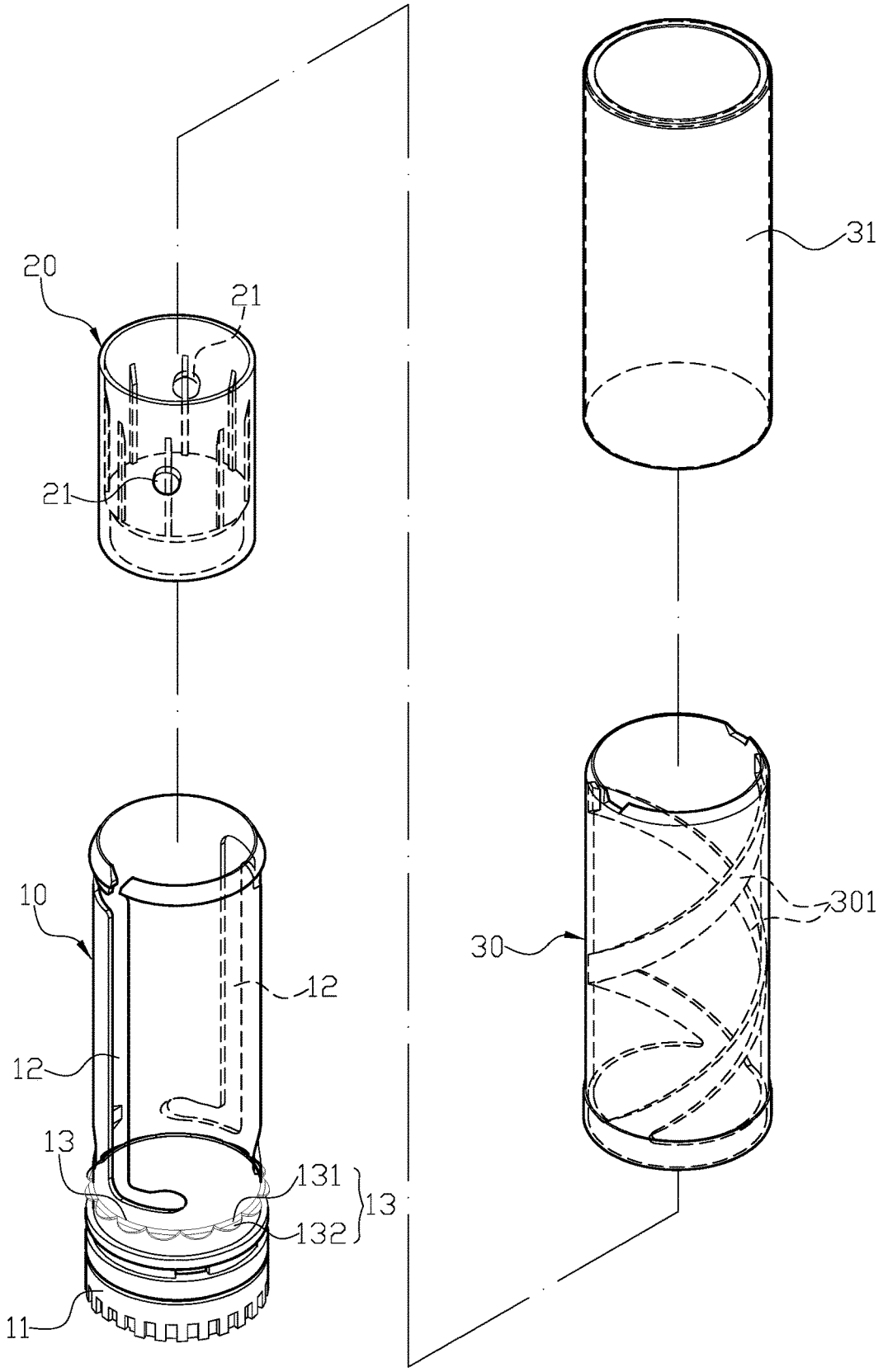
FIG. 2 is a three-dimensional exploded view of the preferred embodiment according to the present invention.
Figure 3:
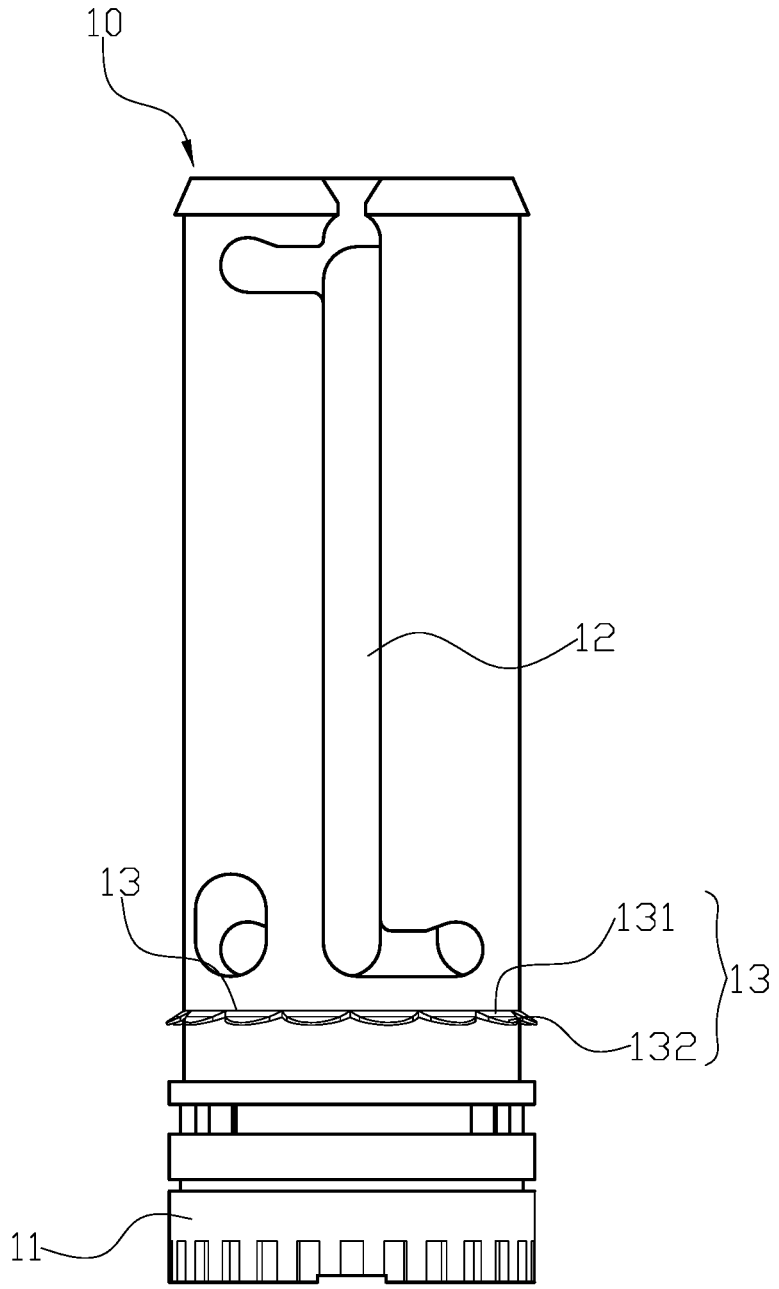
FIG. 3 is an enlarged view of the inner tube of the preferred embodiment according to the present invention.
Figure 4:
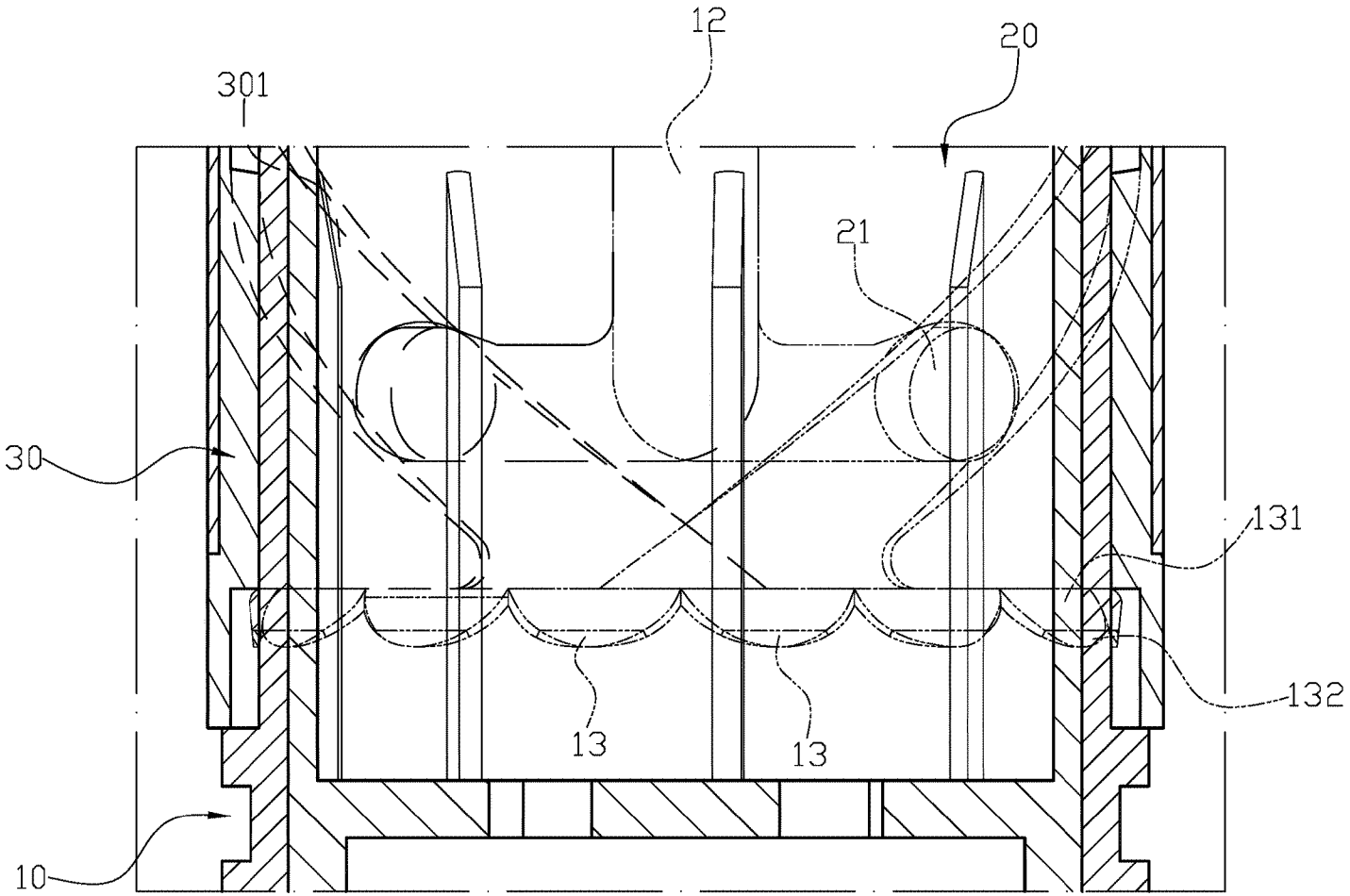
FIG. 4 is the combined sectional view of the preferred embodiment according to the present invention.
Figure 5:
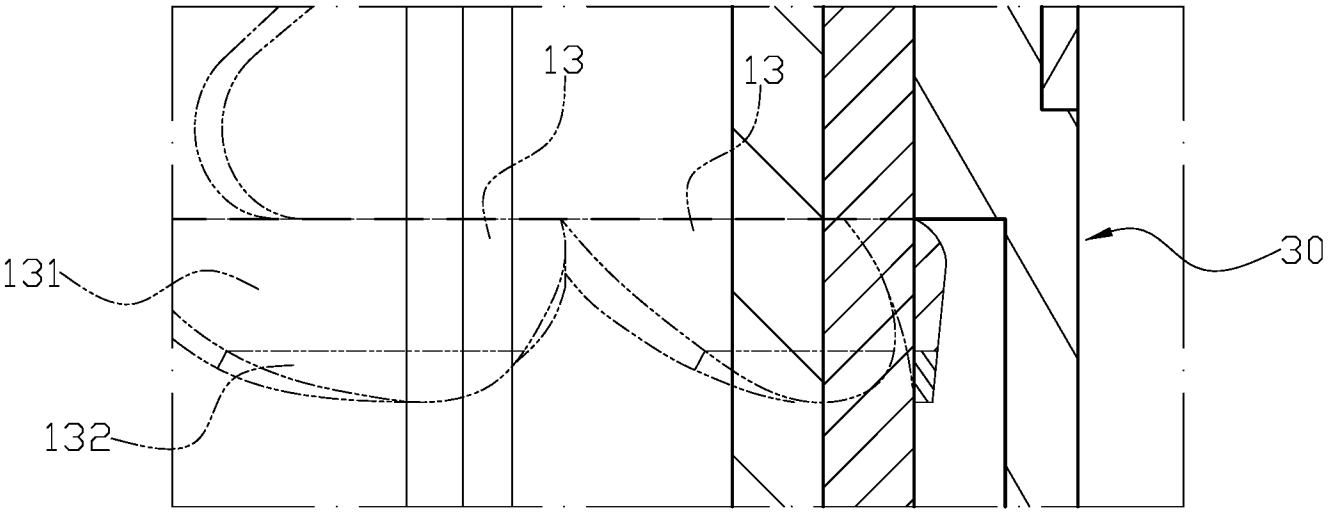
FIG. 5 is a partially enlarged view of the preferred embodiment according to the present invention.

First, please refer to FIG. 1 to FIG. 5. A coaxial container for dispensing a tubular product comprises an inner tube 10 connected to a rotating base 11 allowing the inner tube 10 and the rotating base 11 to rotate relatively. Two opposite positions on a surface of the inner tube 10 are provided with an L-shaped sliding channel 12. A filling seat 20 is inserted in the inner tube 10 and has two convex shafts 21 respectively at opposite positions engaging with the sliding channels 12, so the filling seat 20 is capable of vertical movement along the sliding channel 12. Moreover, the inner tube 10 is covered by a sleeve 30, and the sleeve 30 is provided with a spiral groove 301 on its inner surface. Therefore, the two convex shafts 21 of the filling seat 20 respectively pass through the sliding channels 12 and engage with the spiral groove 301. With the rotation of the rotating base 11, the filling seat 20 is driven by the spiral groove 301 to cause vertical movement. A plurality of elastic latches 13 are arranged in a full circle and disposed on a bottom portion of the inner tube 10 connected to the rotating base 11. Each elastic latch 13 has a harder and thicker first potion 131 and a softer and thinner second potion 132, and the first potion 131 of the elastic latch 13 is capable of making contact with the inner tube 10. Furthermore, the bent-back second potion 132 is used as an auxiliary support, which makes the elastic latches 13 to have a better bearing strength and improve the concentricity between the inner tube 10 and the sleeve 30 for smooth operation.

In addition, the sleeve 30 is configured to match a cover 31.

With the structure of the above specific embodiment, the following benefits can be obtained: With the resistance provided by a full circle of the elastic latches 13, the coaxial container can be operated more smoothly. Since each elastic latch 13 has the harder first potion 131 and the softer the second potion 132, after the assembly of the inner tube 10 and the sleeve 30, the first potion 131 with stronger resilient force forms a full circle of resistance against the inner wall of the sleeve 30, and the bent-back second potion 132 is used as an auxiliary support, which makes the elastic latches 13 to have a better bearing strength and improve the concentricity between the inner tube 10 and the sleeve 30 for smooth operation. Furthermore, with the support provided by the bent elastic latches 13, there is no need to fill or apply any lubrication oil between the inner tube 10 and the sleeve 30, which allows a safe, hygiene and convenient assembly.

Although the present invention has been explained in relation to its preferred embodiment, it is to be understood that many other possible modifications and variations can be made without departing from the spirit and scope of invention as hereinafter claimed.

What is claimed is:

1. A coaxial container for dispensing a tubular product comprising:

an inner tube connected to a rotating base allowing the inner tube and the rotating base to rotate relatively, two opposite positions on a surface of the inner tube provided with a respective L-shaped sliding channel;

a filling seat inserted in the inner tube and having two convex shafts respectively at opposite positions engaging with the sliding channels, the filling seat capable of vertical movement along the sliding channels;

the inner tube being covered by a sleeve, the sleeve provided with two spiral grooves on an inner surface, the two convex shafts of the filling seat respectively passing through the sliding channels and engaging with the spiral grooves;

wherein rotation of the rotating base causes the filling seat to be driven by the spiral grooves to cause vertical movement; and wherein a plurality of elastic latches are disposed around a bottom portion of the inner tube and connected to the rotating base, each elastic latch having a thicker and wider first potion and a thinner and narrower second potion, each first potion of the elastic latch is capable of making contact with the inner tube and further configured to engage against an inner wall of the sleeve, each second portion bendable to provide an auxiliary support.

2. The coaxial container for dispensing a tubular product as claimed in claim 1, wherein the sleeve is configured to match a cover.

* * * * *